US007171836B1

(12) United States Patent
Neudorf

(10) Patent No.: US 7,171,836 B1
(45) **Date of Patent: *Feb. 6, 2007**

(54) ROOFING PANEL NOTCHING, SHEARING, AND HEMMING TOOL

(75) Inventor: Brent Neudorf, Keyes, CA (US)

(73) Assignee: Swenson Shear, Keyes, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/321,230

(22) Filed: Dec. 29, 2005

Related U.S. Application Data

(63) Continuation-in-part of application No. 10/696,661, filed on Oct. 28, 2003, now Pat. No. 7,080,538.

(51) Int. Cl.
*B21D 5/04* (2006.01)

(52) U.S. Cl. ..... 72/319; 72/332

(58) Field of Classification Search ..... 108/147.21; 409/227; 72/332, 319

See application file for complete search history.

(56) References Cited

U.S. PATENT DOCUMENTS 6,085,569 A * 7/2000 Chubb et al. ..... 72/319

6,289,824 B1 * 9/2001 Parker et al. ..... 108/115

* cited by examiner

*Primary Examiner*—Lowell A. Larson
*Assistant Examiner*—Debra Wolfe
(74) *Attorney, Agent, or Firm*—The Kline Law Firm

(57) ABSTRACT

A notching, shearing, and hemming tool constructed with a table which receives the roofing panel, at least two notching devices (notchers), a pan shear pivotally mounted on the table, and a hemming tool pivotally mounted on the table. To prepare a finished end piece of roofing panel, the roofing panel is placed in a panel alignment section at a first end of the tool. Each of the notching devices is movable, so that the relative position of the two notchers is variable. After notching, the roofing panel is moved to the pan shear, which is set at the proper angle by movement of a lever mechanism connected to the notchers. The roofing panel is sheared along a center line of the notched area. This cut leaves a tongue of the flat pan of the roofing panel exposed on each cut piece. Following the shearing operation, the user is left with two cut panels, each having an exposed tongue section an inch-and-a-half long extending from the pan section. Panels to be used in valleys or at eaves are then hemmed with the hemmer.

14 Claims, 20 Drawing Sheets

ROOFING PANEL NOTCHING, SHEARING, AND HEMMING TOOL

This application is a continuation-in-part of U.S. application Ser. No. 10/696,661, filed Oct. 28, 2003, now U.S. Pat. No. 7,080,538.

BACKGROUND OF THE INVENTION

1. Field of the Invention

The present invention relates generally to roofing construction tools, and more particularly is a device to notch, shear, and hem the ends of roofing panels in preparation for installation on hips, valleys, ridges, and at eaves.

2. Description of the Prior Art

Metal roofing panels are used on many types of building construction, and especially for commercial construction. In a standing seam roof panel system such as is addressed in the present invention, the panels are fairly heavy metal, with ribs projecting upward on each side to connect with ribs of adjacent panels when the panels are installed on a roof. The panels may be joined either by a seamer that crimps the panels so that they are interlocked, or the ribs may be provided with a snap lock mechanism.

At the hips, valleys, ridges, and eaves of the roof, the roofing panels must be cut to fit properly. Because the roofing panels are formed from stiff metal, they can be very difficult to cut. The panels currently are most commonly cut with hand tools, such as metal snips. When installing panels in valleys and at eaves, the ribs of the panels must be notched to create an exposed tongue of the panel. The tongue is then folded under ("hemmed") so that the hem can slide into a metal cleat which holds the panel end firmly in place. Making the straight cuts required at the eaves is difficult enough, but the angled cuts required at hips and valleys present an even greater problem.

There are many tools in the prior art designed to cut metal panels. The tools that have some relevance to the roofing application discussed herein resemble heavy duty paper cutters, that is, they are shear devices with an associated table to at least in some way secure the piece to be cut. One such device is the "Apparatus for Cutting Metal and Plastic Sheet" of Kania, U.S. Pat. No. 5,010,795, issued Apr. 30, 1991. Another is the "Sheet Metal Shear" of Ireland, U.S. Pat. No. 4,387,616, issued Jun. 14, 1983.

Yet another shearing device is disclosed in the "Sheet-metal Shearing Apparatus" of Jasinski, U.S. Pat. No. 3,771,401, issued Nov. 13, 1973. This device introduces a means to support a flange while the sheet is being cut.

Fewer disclosures are related to the notching of the ribs of a roofing panel. One such reference is the "Notching Tool" of Stubbersfield et al., U.S. Pat. No. 4,446,623, issued May 8, 1984. This patent discloses a portable hand tool to cut the notches required on roofing panels for hip or ridge capping.

There is no device in the prior art that allows full end treatment of a standing seam roof system roofing panel. Accordingly, it is an object of the present invention to provide a device that enables the user to notch, shear, and hem an end of a roofing panel.

It is another object of the present invention to provide a machine that allows the user to cut the end of the roofing panel to whatever angle is desired.

It is still another object of the present invention to provide a device that provides support for the ribs so that they are not deformed during the notching or shearing operations.

SUMMARY OF THE INVENTION

The present invention is a notching, shearing, and hemming tool. The tool comprises a table which receives the roofing panel, at least two notching devices (notchers), a pan shear, and a hemmer. To prepare a finished end piece of roofing panel, the roofing panel is placed in a panel alignment section at a first end of the tool. At least one of the notching devices is movable, so that the relative position of the two notchers is variable. Depending on the angle of the end cut required, the front notcher is moved to an appropriate position along a guide rail on the lower side of the support table. The rear notcher, being attached by levers to the front notcher, automatically moves to the correct position relative to the front notcher.

Both the front notcher and the rear notcher remove sections of the side ribs of the roofing panel. The notchers include dies that support the side ribs of the roofing panel so that a clean cut is achieved when the notchers are activated. The notchers each remove a section of the side rib that is approximately 3 inches wide. the removed section extends into the flat pan section of the panel approximately 0.2 inches.

The roofing panel is then moved to the pan shear, which is set at the proper angle by movement of the mechanism connecting the front and rear notchers. The roofing panel is, sheared along a center line of the notched area. This cut leaves a tongue of the flat pan of the roofing panel exposed on each cut piece. Following the shearing operation, the user is left with two cut panels, each having an exposed tongue section an inch-and-a-half long extending from the pan section.

For panels to be installed in valleys or at eaves, the tongue section is then hemmed by moving the panel to the hemming tool located next to the pan shear at the end of the table. The hemmer folds the tongue of the pan under to a 140° angle. The hem is then flattened to a 180° angle in final preparation for installation.

An advantage of the present invention is that the tool performs the complete finishing process required for end pieces of the roofing panels.

Another advantage of the present invention is that each cut provides a pair of mirror image finished panel ends.

A still further advantage of the present invention is that the tool can be used to cut any angle that is desired for the end pieces.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
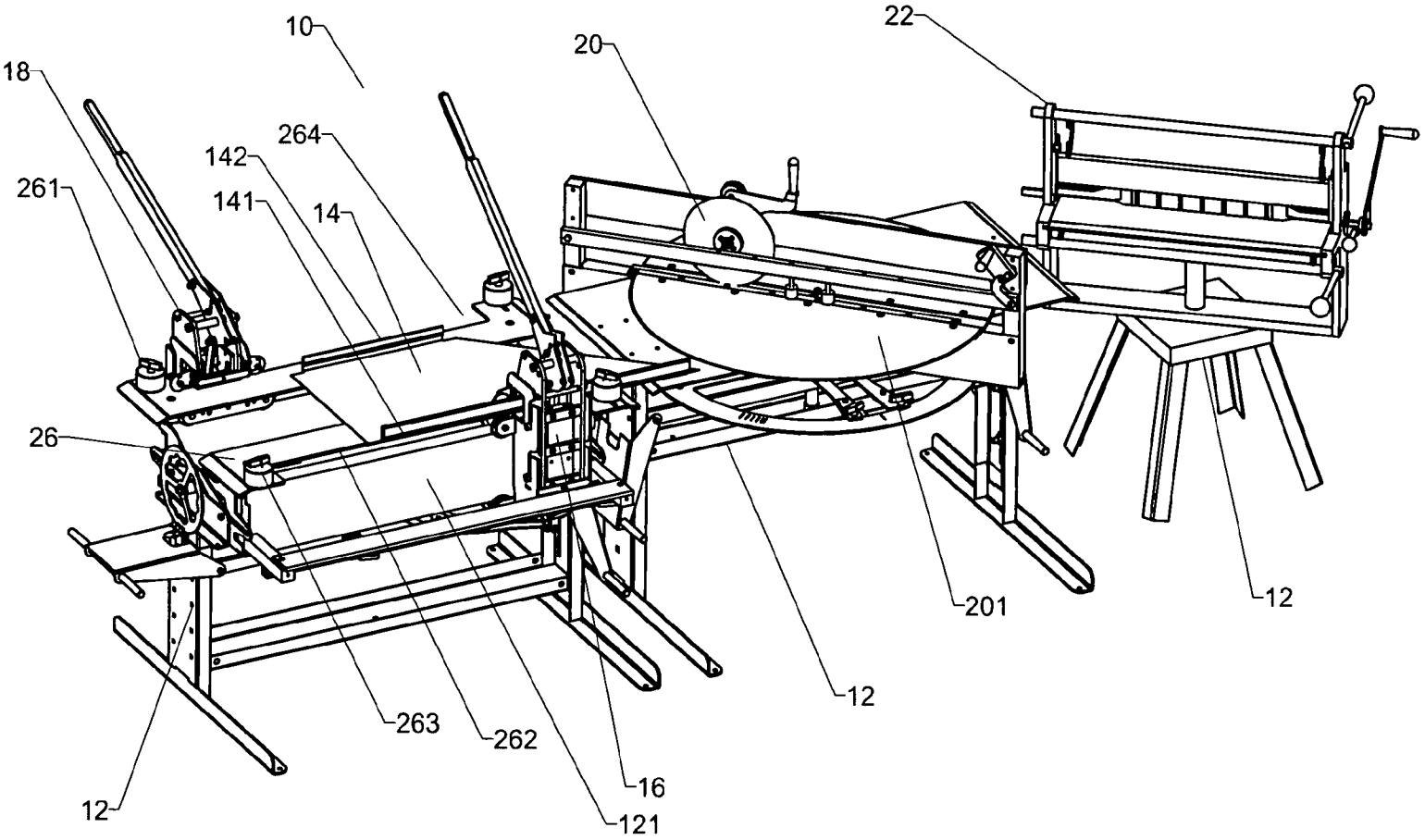
FIG. 1 is a perspective view of the notching, shearing, and hemming tool of the present invention.
Figure 2:
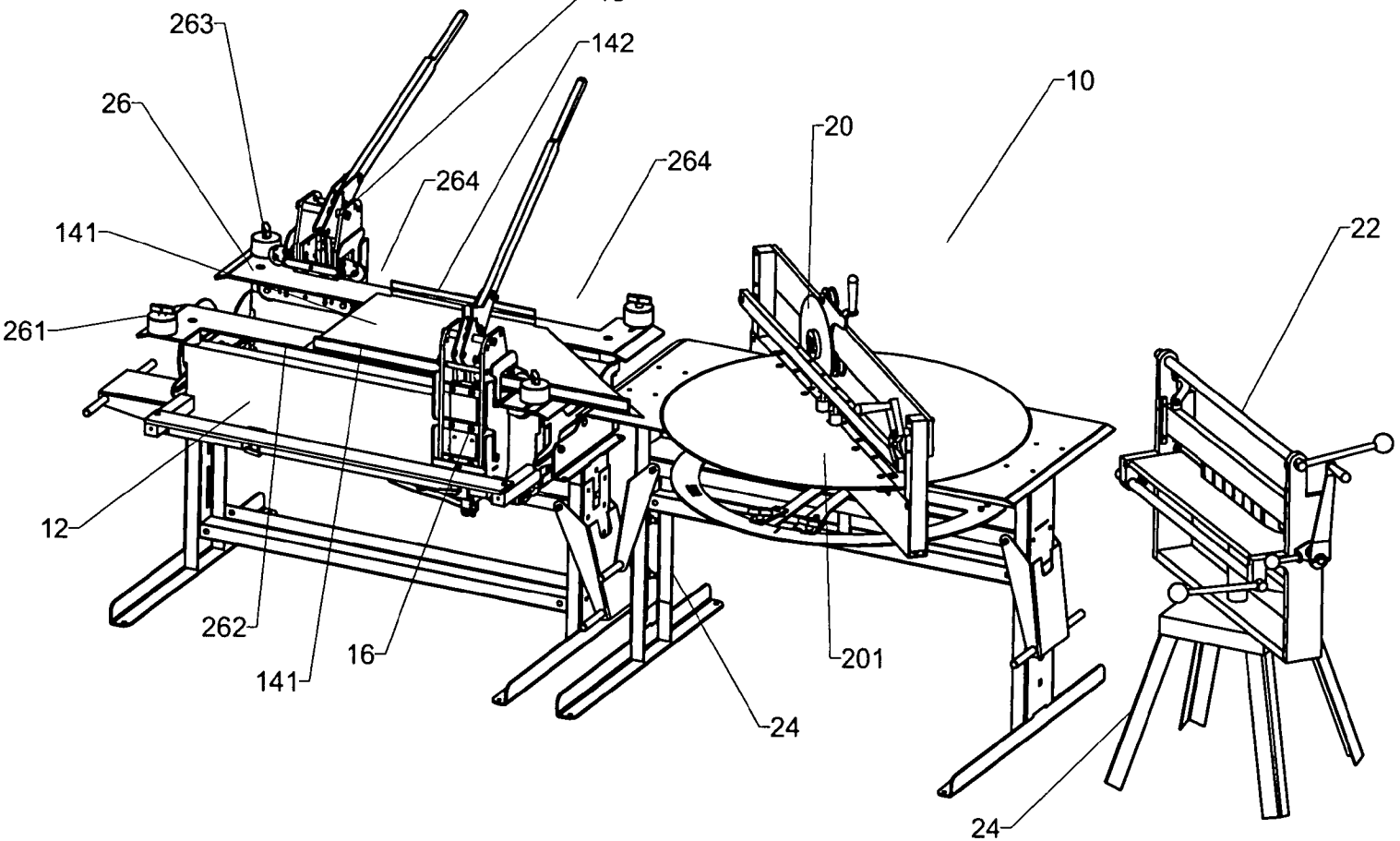
FIG. 2 is another perspective view of the notching, shearing, and hemming tool.

The present invention is a notching, shearing, and hemming tool 10, called a snap table. The tool 10 comprises a support table 12 which receives a roofing panel 14. A front notcher 16 and a rear notcher 18 are mounted on opposing sides of a first stage of the support table 12. The notchers 16, 18 are movable in order to change the cut end angle of the roofing panel 14. The support table 12 is mounted on adjustable legs 24. The adjustable legs allow the table 12 to be stably positioned on angled surfaces. Those skilled in the art will readily recognize that many mechanisms can be used to accomplish the length variability of the legs 24. In the preferred embodiment, a pair of nested leg sections is utilized.

Near the center of the table 12 at a second stage, a pan shear 20 is pivotally mounted so that the pan shear 29 can swivel to the proper angle. At a third stage, a hemmer 22 is mounted near a terminal end of the table 12. The hemmer 22 is pivotally mounted on the table 12 so that the hemmer 22 can swivel to match the angle of the pan shear 20.

A first end of the support table 12 comprises a panel alignment section 26 to secure and properly align the roofing panel 14 for the notching and shearing operations. In the preferred embodiment, the notches cut on each side of the panel 14 are three inches wide. Side walls 261, 263 of the panel alignment section 26 have extended openings 262 and 264 to accommodate varying positions of the movable notchers 16, 18. In the preferred embodiment, the openings 262 and 264 are thirty inches long. This gives the tool 10 the capacity to end cut angles of ±55' for standard standing seam roofing panels.

Figure 3:
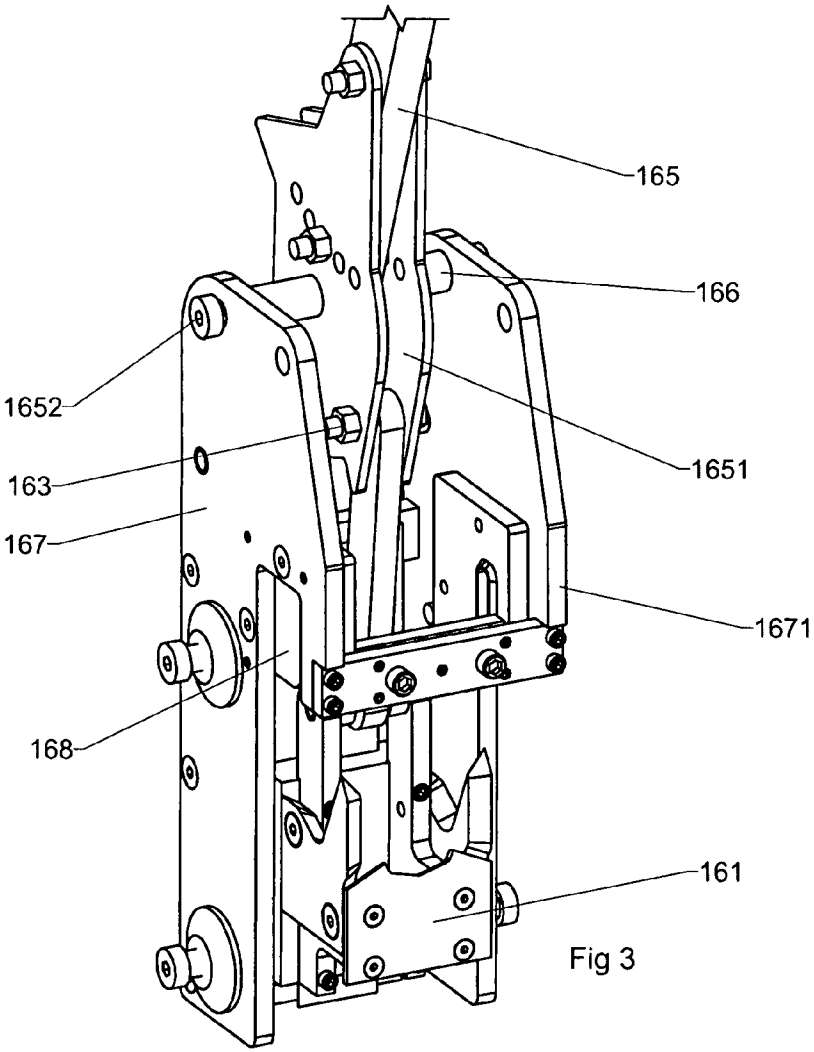
FIG. 3 is a perspective view of a notching device according to the present invention in an open position.
Figure 4:
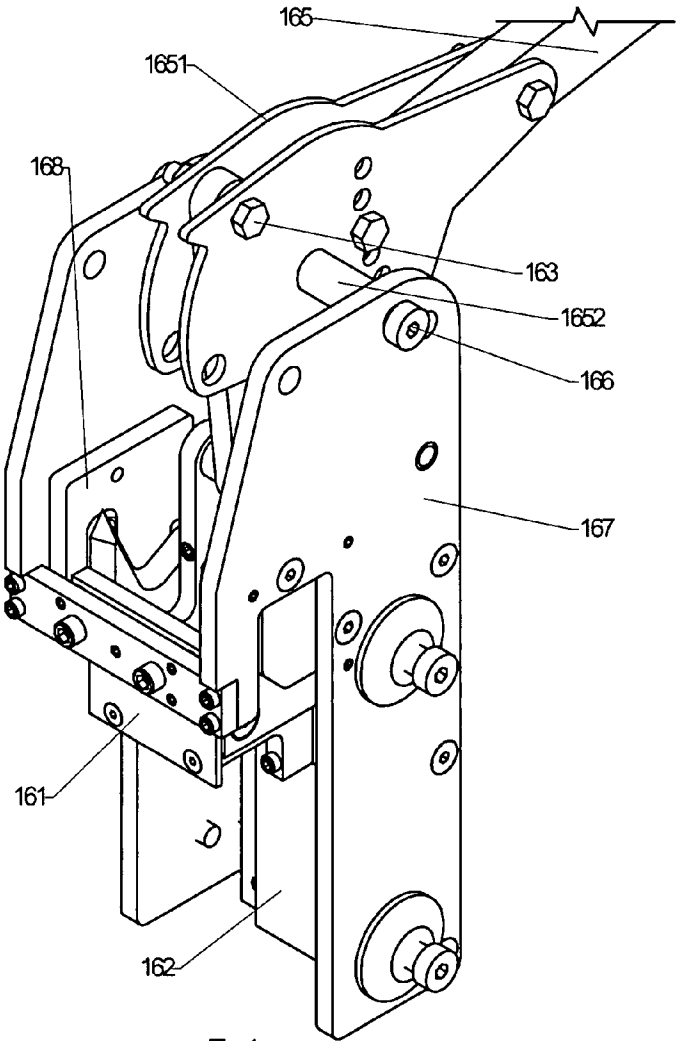
FIG. 4 is a perspective view of the notching device in an actuated position.
Figure 5:
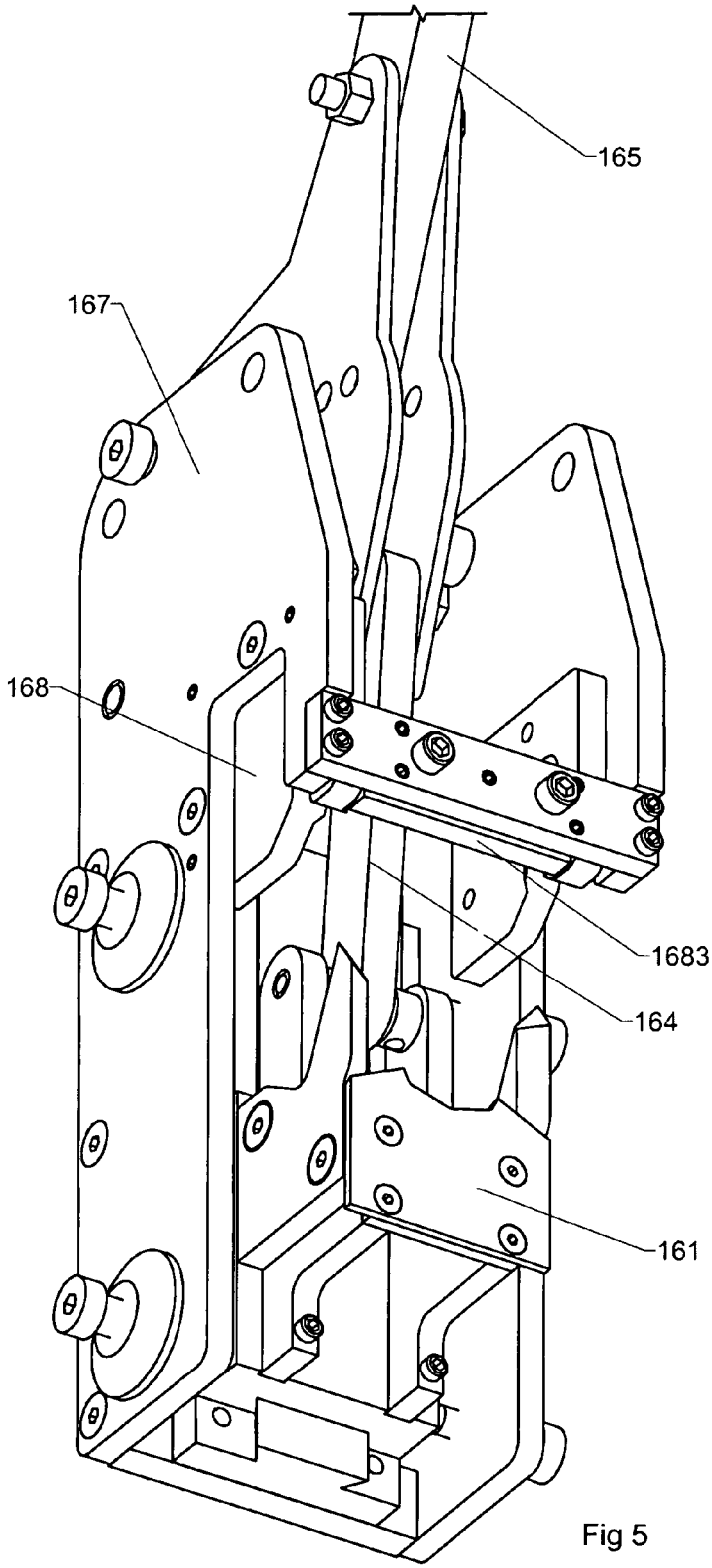
FIG. 5 is a bottom perspective view of the notching device in an open position.
Figure 6:
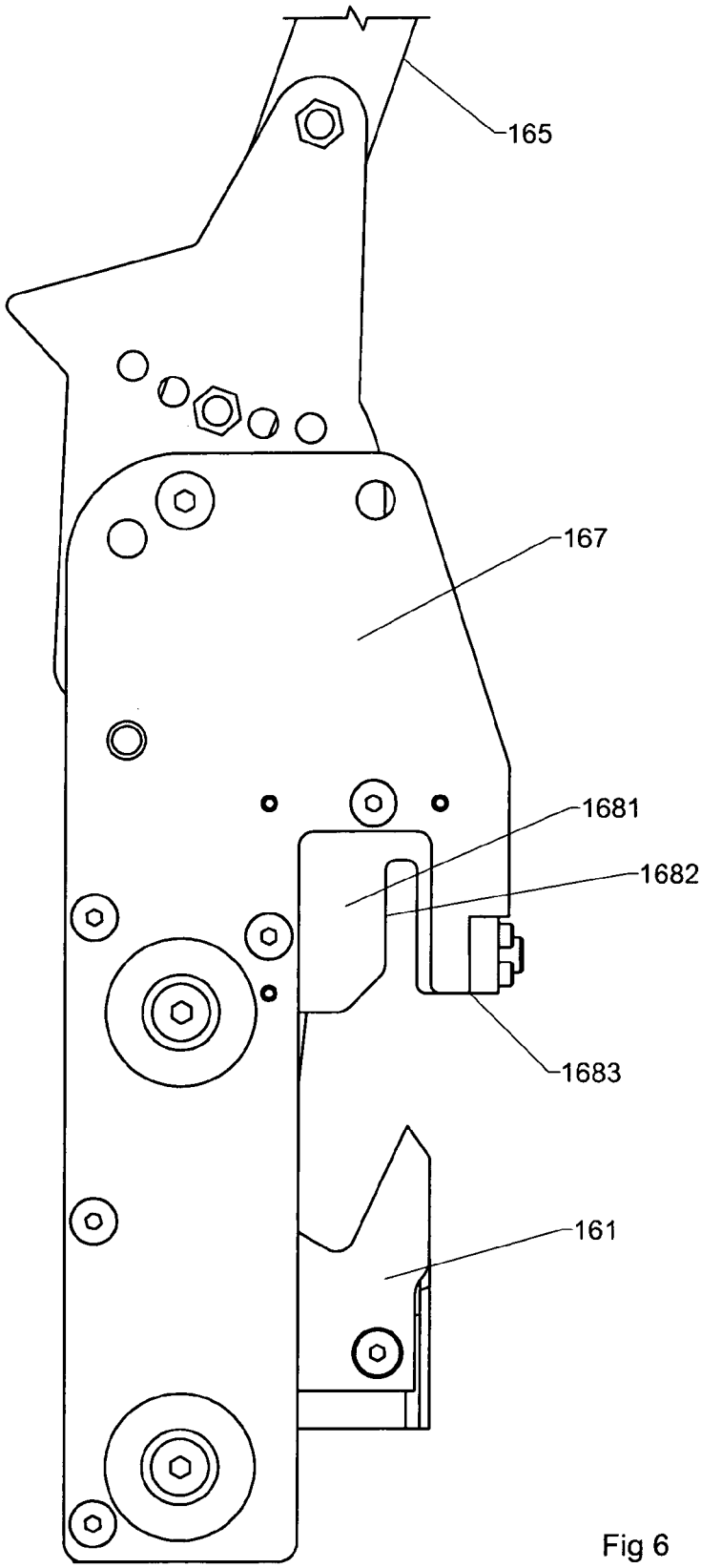
FIG. 6 is a side view of the notching device in an open position.
Figure 7:
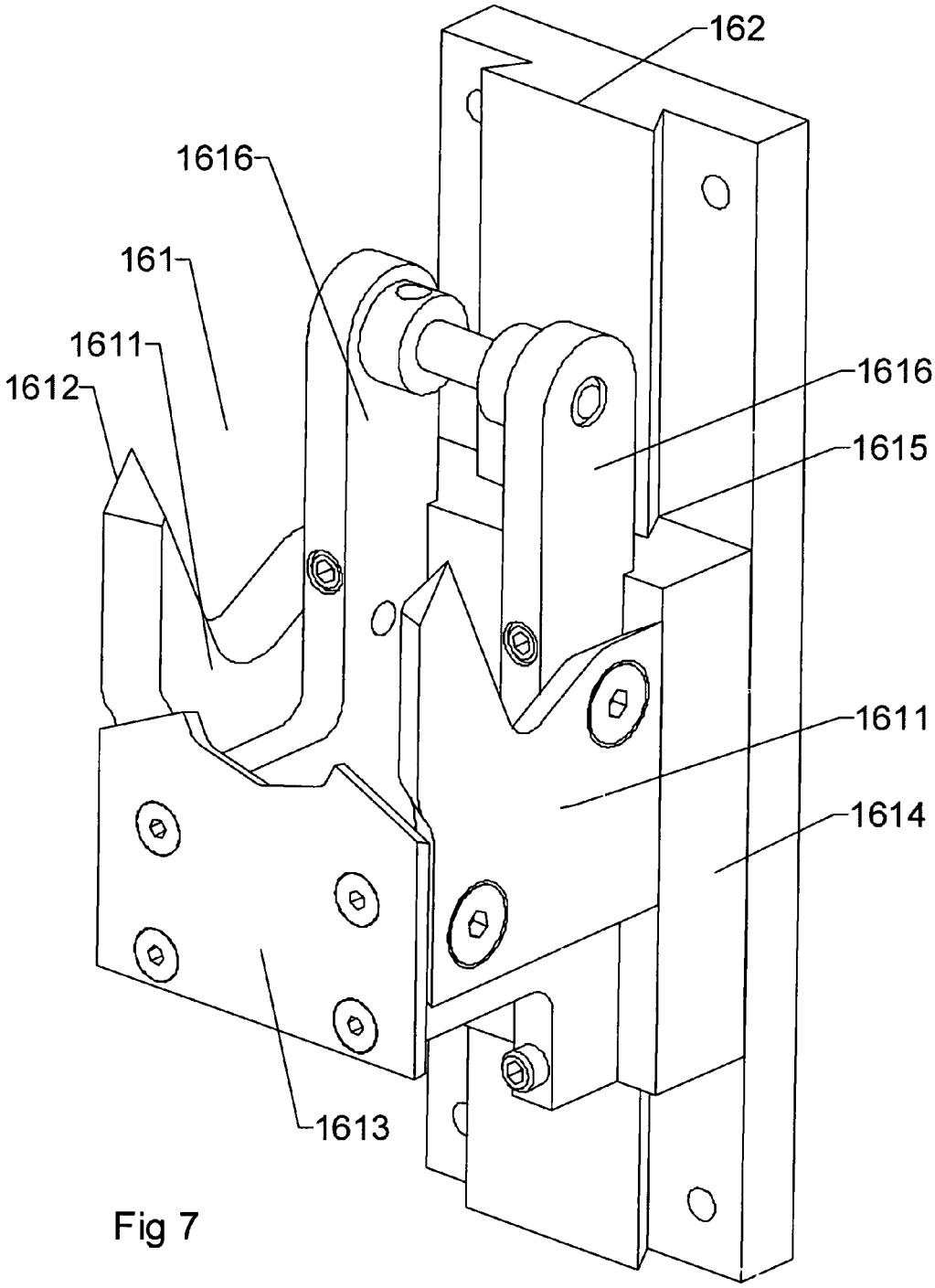
FIG. 7 is a perspective view of the lower die of the notching device.
Figure 8:
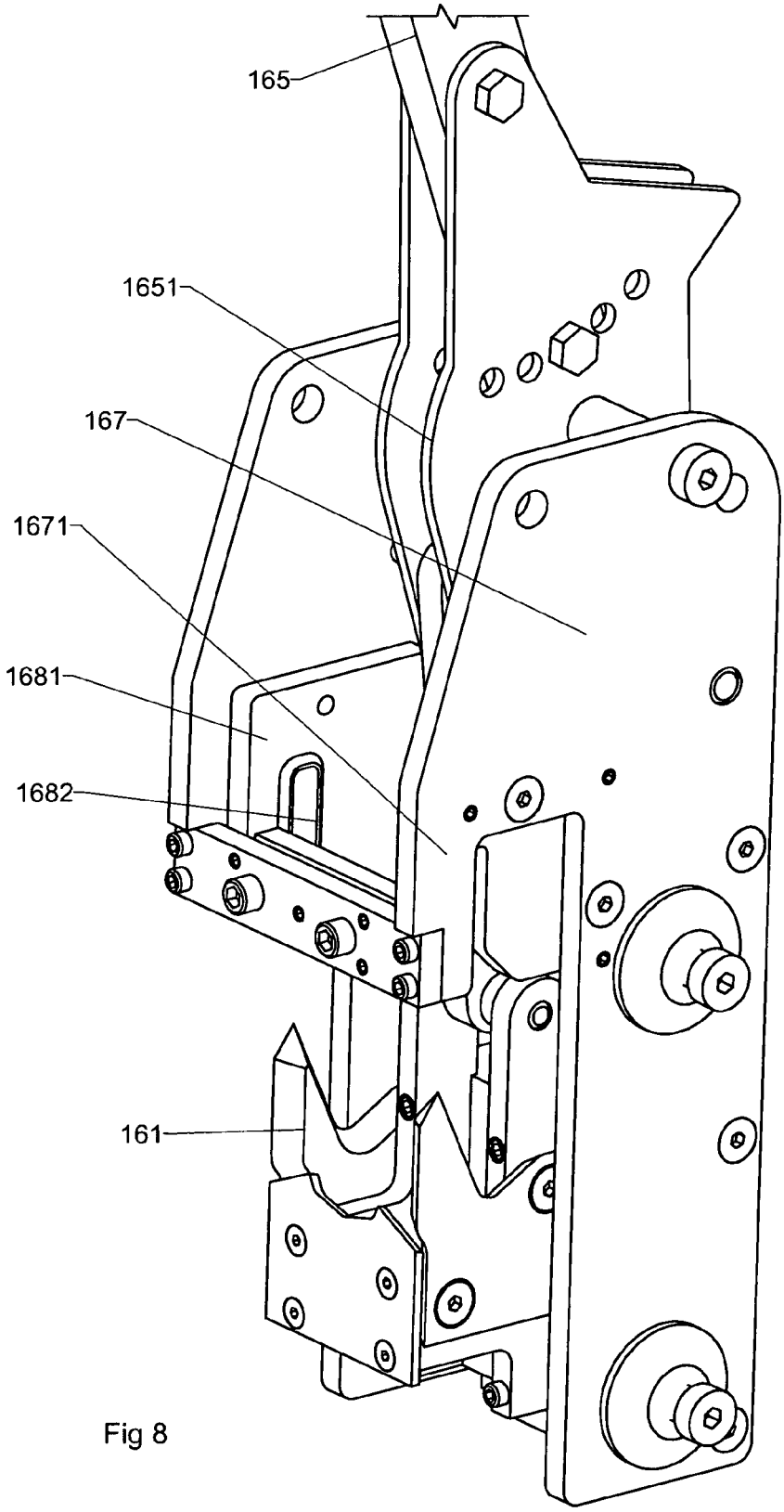
FIG. 8 is a top perspective view of the notching device showing the arm stop assembly locking the actuating arm in an open position.
Figure 9:
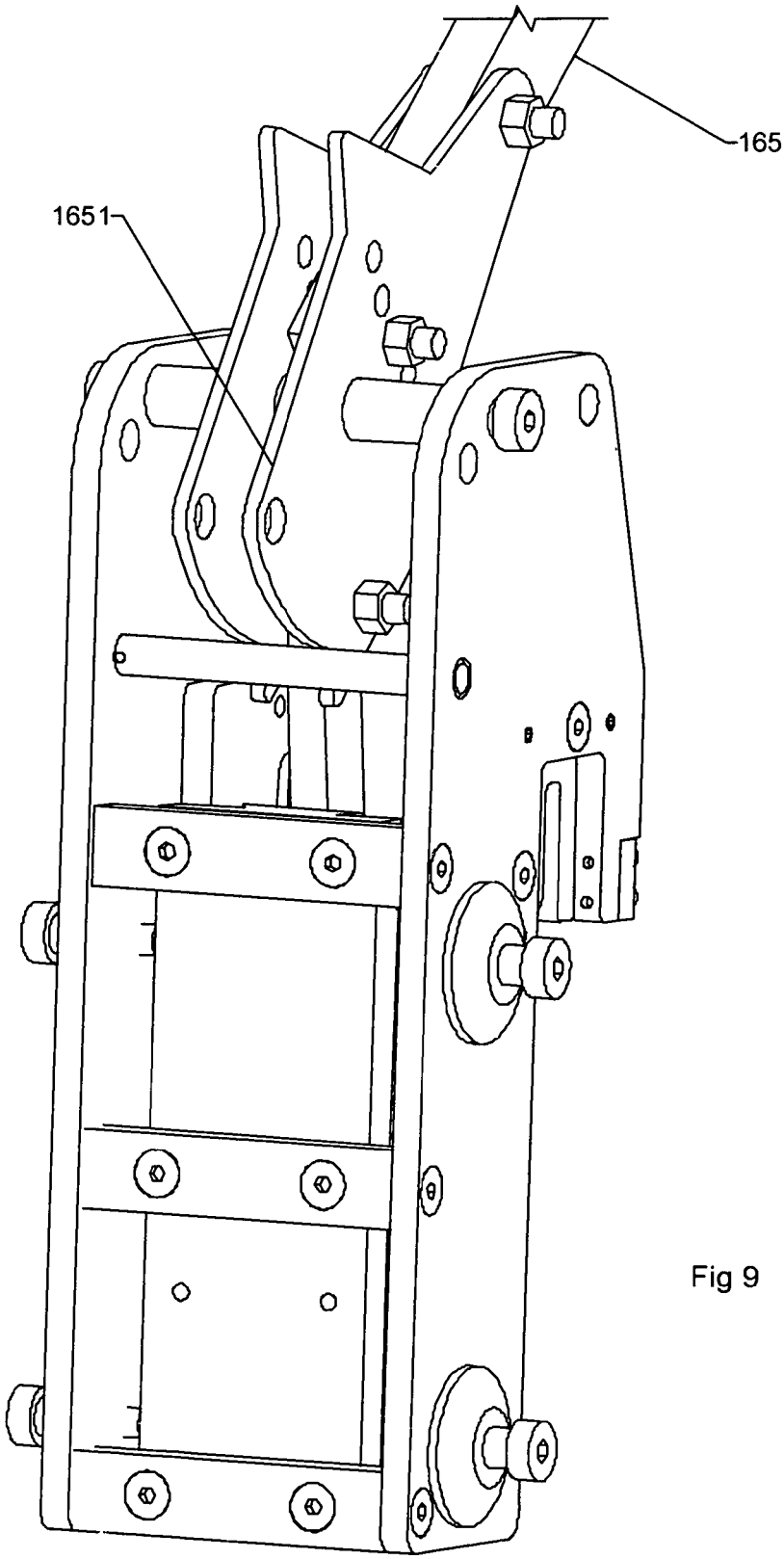
FIG. 9 is a top perspective view of the notching device showing the arm stop assembly in a released position.

In the preferred embodiment, the notchers 16, 18 are identical in structure. The structure of the notchers will therefore be described with general reference to the first notcher 16 shown in FIGS. 3–9. FIG. 3 shows the notcher 16 in an open position ready to receive a side rib 141, 142 of the roofing panel 14. FIG. 4 shows the notcher 16 in a closed position after the cutting motion is completed.

Each notcher 16 includes a bottom die 161. The bottom die 161 includes supporting side projections 1611 that are designed to fit into the channel formed by the female side rib 141. While both the female rib 141 and the male rib 142 are both cut by the notchers 16, 18, it is more important for the female rib 141 to have a clean cut than for the male rib 142 in order to enable easy assembly of adjacent roofing panels 14. Therefore, in the preferred embodiment, the bottom die 161 is structured to sever the female rib 141 while the top die 168 maintains the original rib profile. Those skilled in the art will readily recognize that various structures of bottom dies 161 can be utilized depending on the shape of the rib of the roofing panel to be notched.

In the preferred embodiment, the bottom die 161 includes a pair of the supporting side projections 1611 that enter the female rib 141 when the panel 14 is cut. The side projections 1611 of course each include a sharpened cutting edge 1612 that aligns with a cutting edge 1682 on the side members 1681. The bottom die 161 further includes a mounting base 1614 with a slide channel 1615 that mates with a slide bar 162. The bottom die 161 travels up and down the slide bar 162 during operation. The slide channel 1615 and the slide bar 162 each have matching trapezoidal cross sections to ensure a secure connection of the bottom die 161 on the slide bar 162.

The bottom die 161 also includes a pair of linkage ears 1616 that connect the bottom die 161 to the actuating mechanism of the notcher 16. The linkage ears 1616 each have a through hole therein to receive a link axle 163 that secures the ears 1616 to a linkage bar 164. The linkage bar 164 is pivotally attached to a lower arm 1651 of an actuating lever 165. A pivot point 1652 of the actuating lever 165 receives a pivot axle 166 that is mounted in a frame 167 of the notcher 16.

A pair of front arms 1671 of the notcher frame 167 receives the top die 168 of the notcher 16. The stationary top die 168 includes side members 1681 with a slot 1682 therein to receive a side rib of the panel 14. The side members 1681 provide an opposing cutting surface for the supporting projections 1611 of the bottom die 161. Similarly, a front member 1683 of the top die 168 provides an opposing cutting surface for the front projection 1613 of the bottom die.

Thus, when the actuating arm 165 is driven downward, the lower arm 1651 is raised, thereby lifting the bottom die 161 via the linkage bar 164. As the bottom die 161 is raised, the side projections 1611 enter the female rib 141 of the panel 14. As the bottom die 161 continues to move upward, the bottom die 161 passes by, in close proximity to, the top die 168. The rib of the panel 14 is cut, thereby completing the notching operation.

Figures 10, 11:
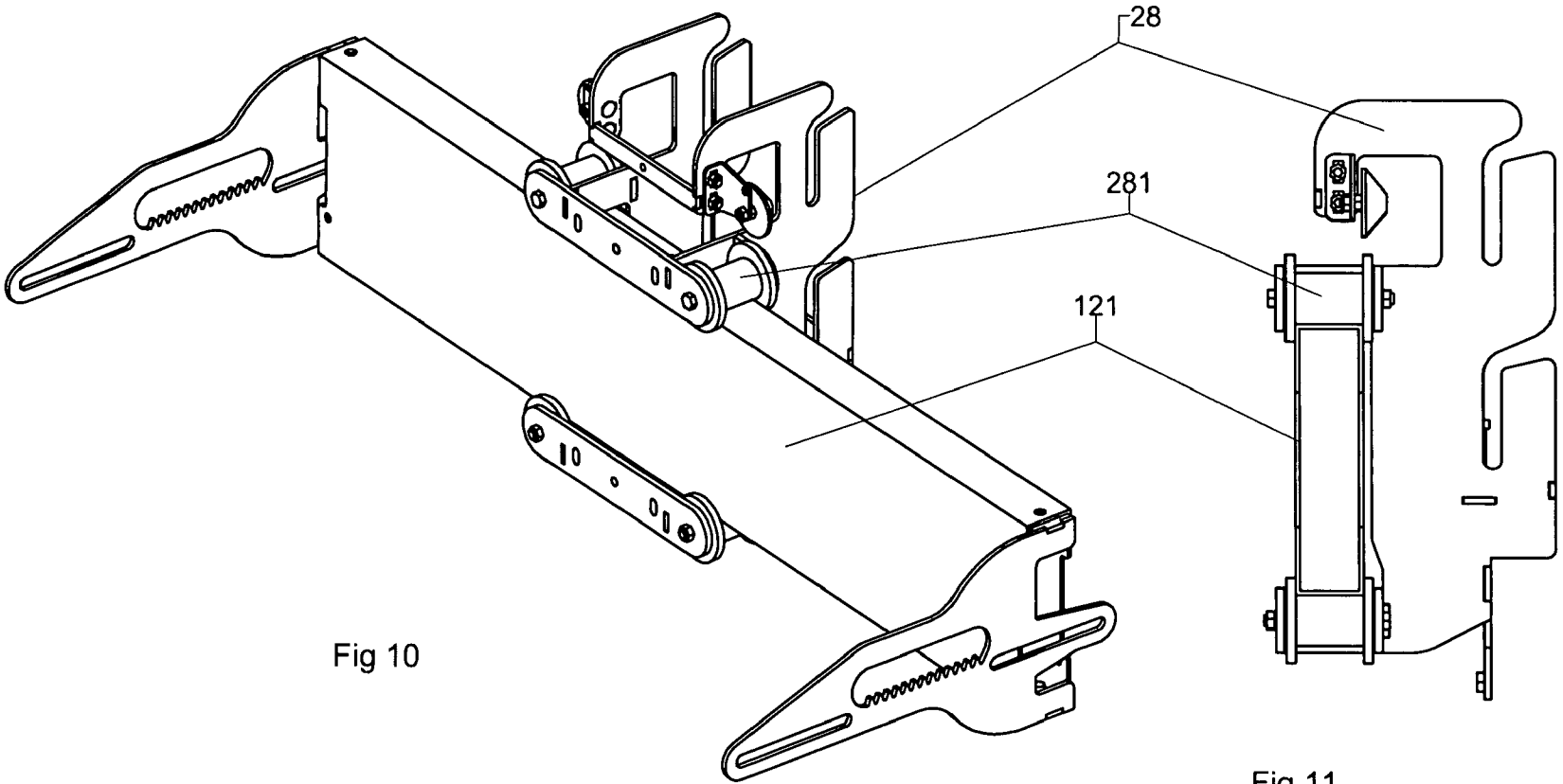
FIG. 10 is a perspective view of a wheeled chassis for a notcher.
FIG. 11 is a side view of the wheeled chassis.

In order to properly notch a panel 14 that is to be cut at an angle, the position of the front notcher 16 must be moved relative to the rear notcher 18. Therefore, in the preferred embodiment, both notchers 16, 18 are mounted on a movable platform. Those skilled in the art will recognize that many constructions are available to accomplish this goal. One such workable structure is illustrated in FIGS. 10–11. Each notcher 16, 18 is mounted on a wheeled chassis 28. The wheels 281 of the chassis 28 are grooved so as to secure the notcher 18 on a travel rail 121 of the support table 12.

Figure 19:
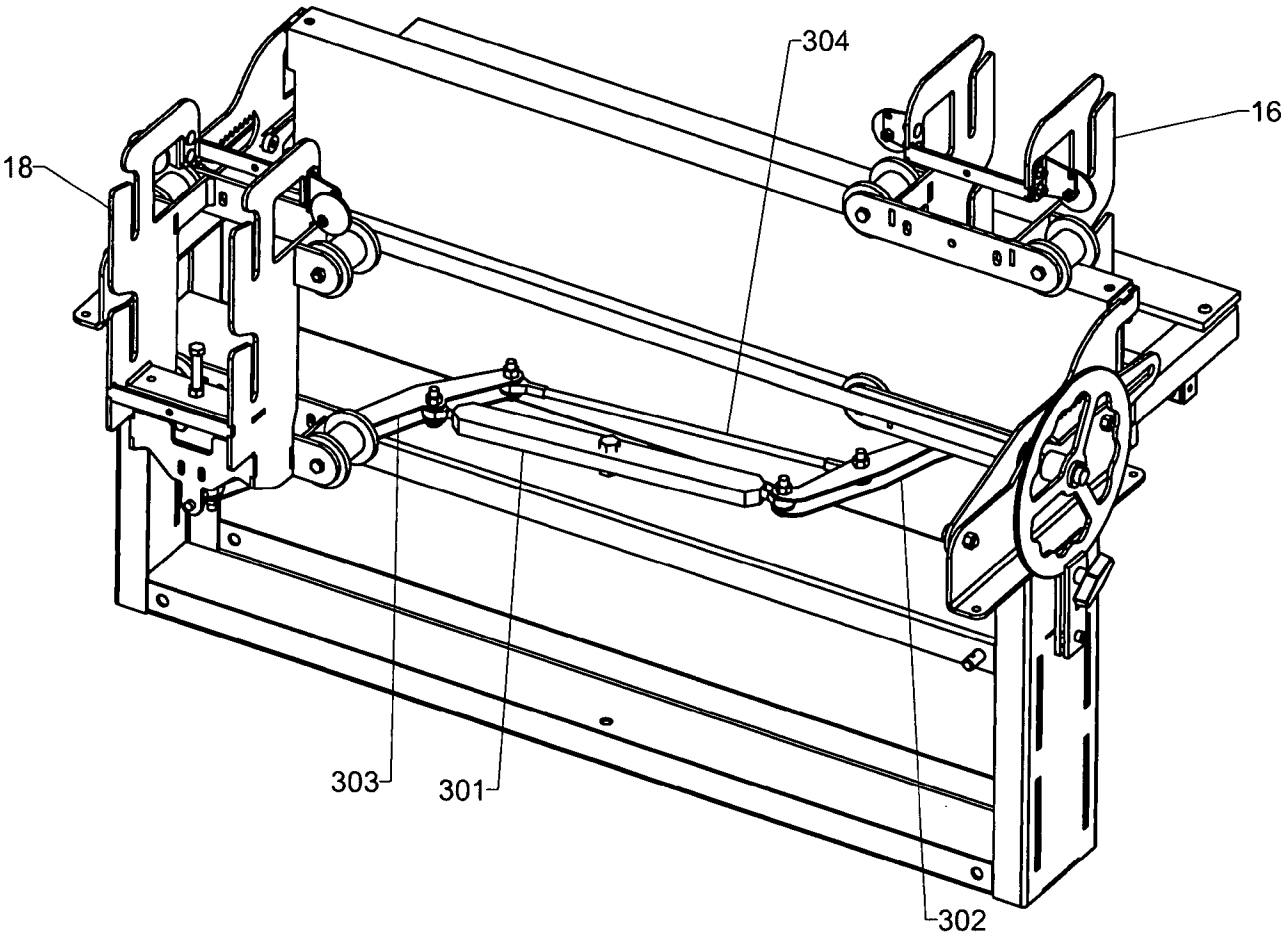
FIG. 19 shows the notchers configured for an angle cut having been positioned by the notcher alignment link mechanism.
Figure 20:
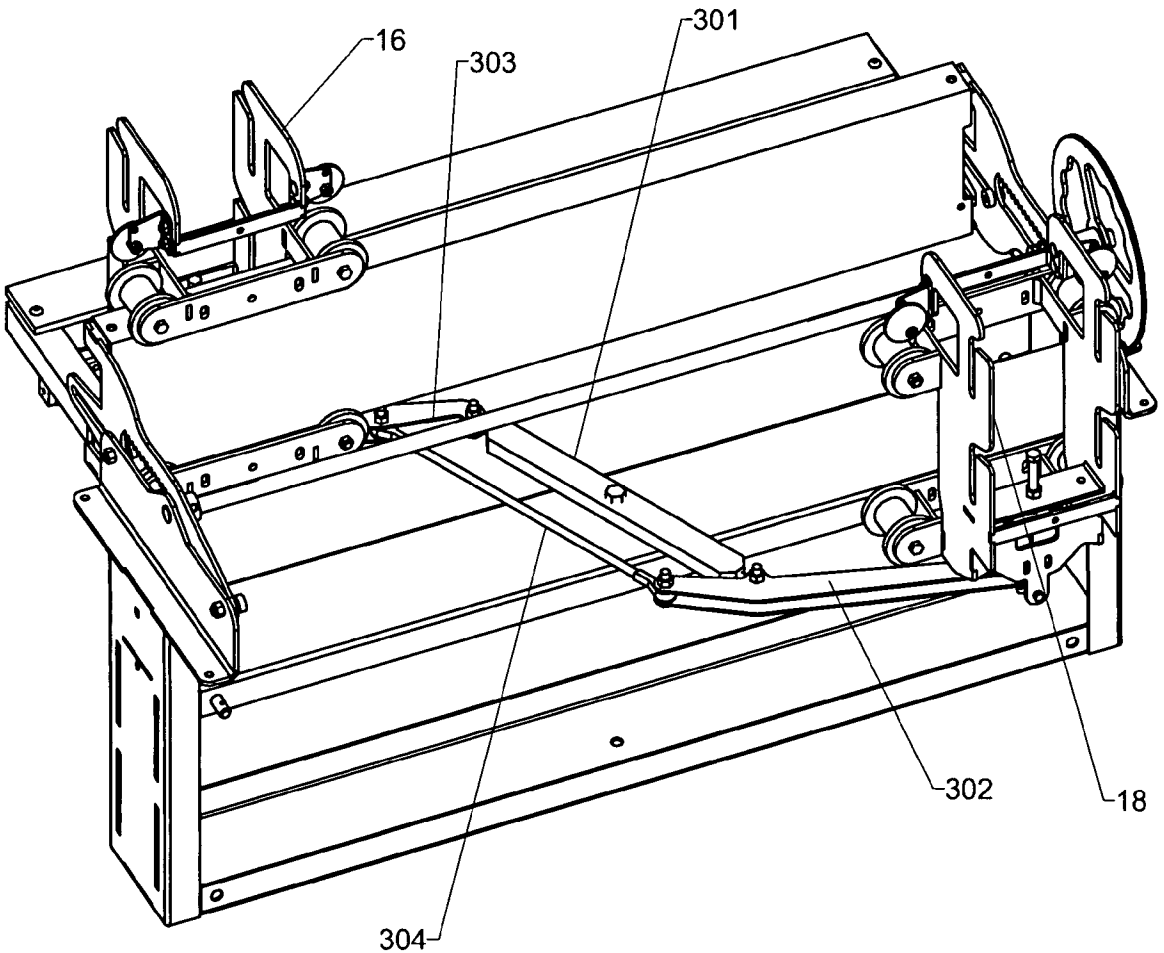
FIG. 20 shows the notchers configured for an opposing angle cut having been positioned by the notcher alignment link mechanism.
Figure 21:
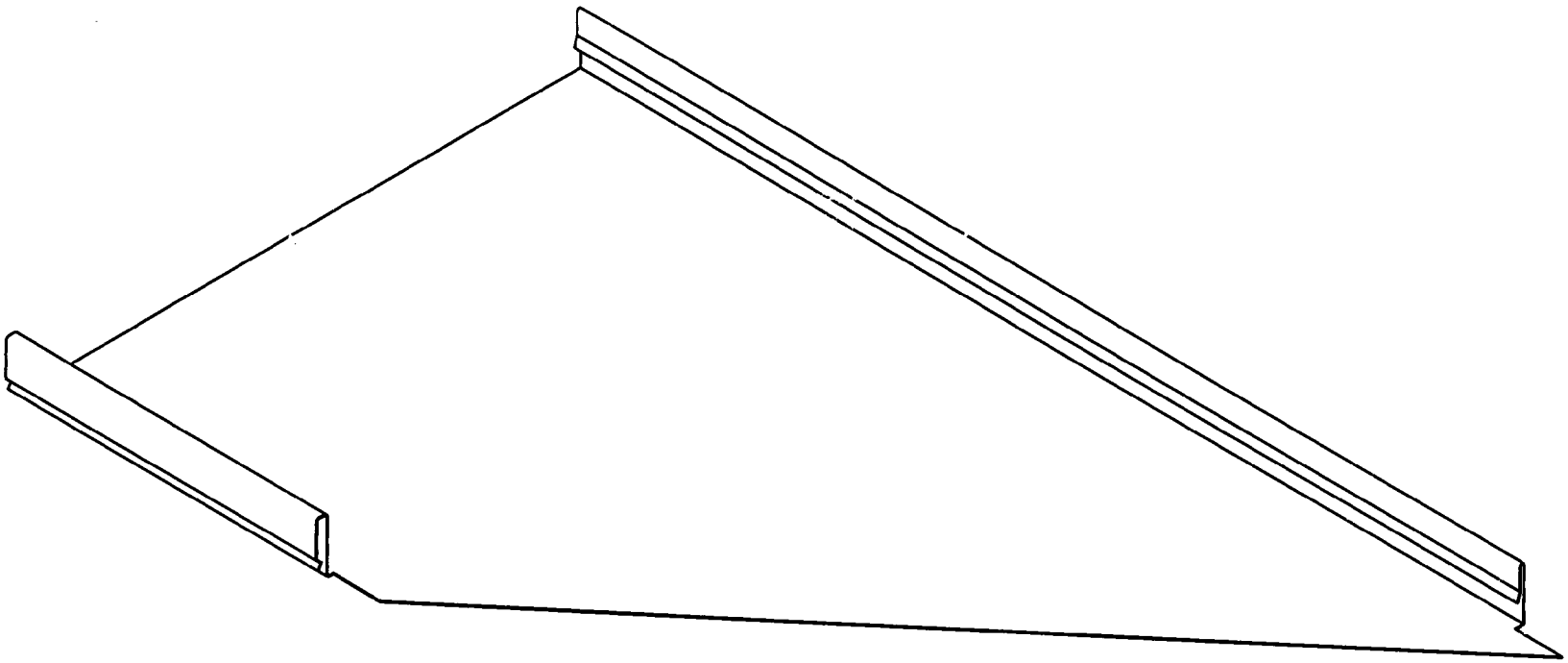
FIG. 21 shows the end ribs of a panel after notching.

Accurate alignment of the two notchers 16, 18 relative to each other is ensured by an alignment mechanism illustrated in FIGS. 19 and 20. Accurate alignment is obtained by a series of four link arms 301, 302, 303, 304 that are pivotally connected to each other and to the chassis 28 of the notchers 16, 18. At least one of the link arms 301, 302, 303, 304 is anchored to the support table 12.

The operation of the notching, shearing, and hemming tool 10 is as follows: The roofing panel 14 is placed in the panel alignment section 26 at a first end of the tool 10. —8—The front notcher 16 is moved to a position to yield the desired angle, and the notchers 16, 18 are actuated with the actuating levers 165. The actuating levers 165 are pressed downward to drive the bottom dies 161 upward to notch the side ribs 141, 142 of the roofing panel 14.

The roofing panel 14 is then moved to the pan shear 20, which is set at the proper angle by connecting the pan shear frame 201 to the notcher positioning mechanism with a link mechanism. The roofing panel 14 is sheared along a center line of the notched area. After the panel 14 is cut, a tongue of the flat pan of the roofing panel 14 is exposed on each cut piece. Following the shearing operation, the user is left with two cut panels, each having an exposed tongue section an inch-and-a-half long extending from the pan section.

Figure 12:
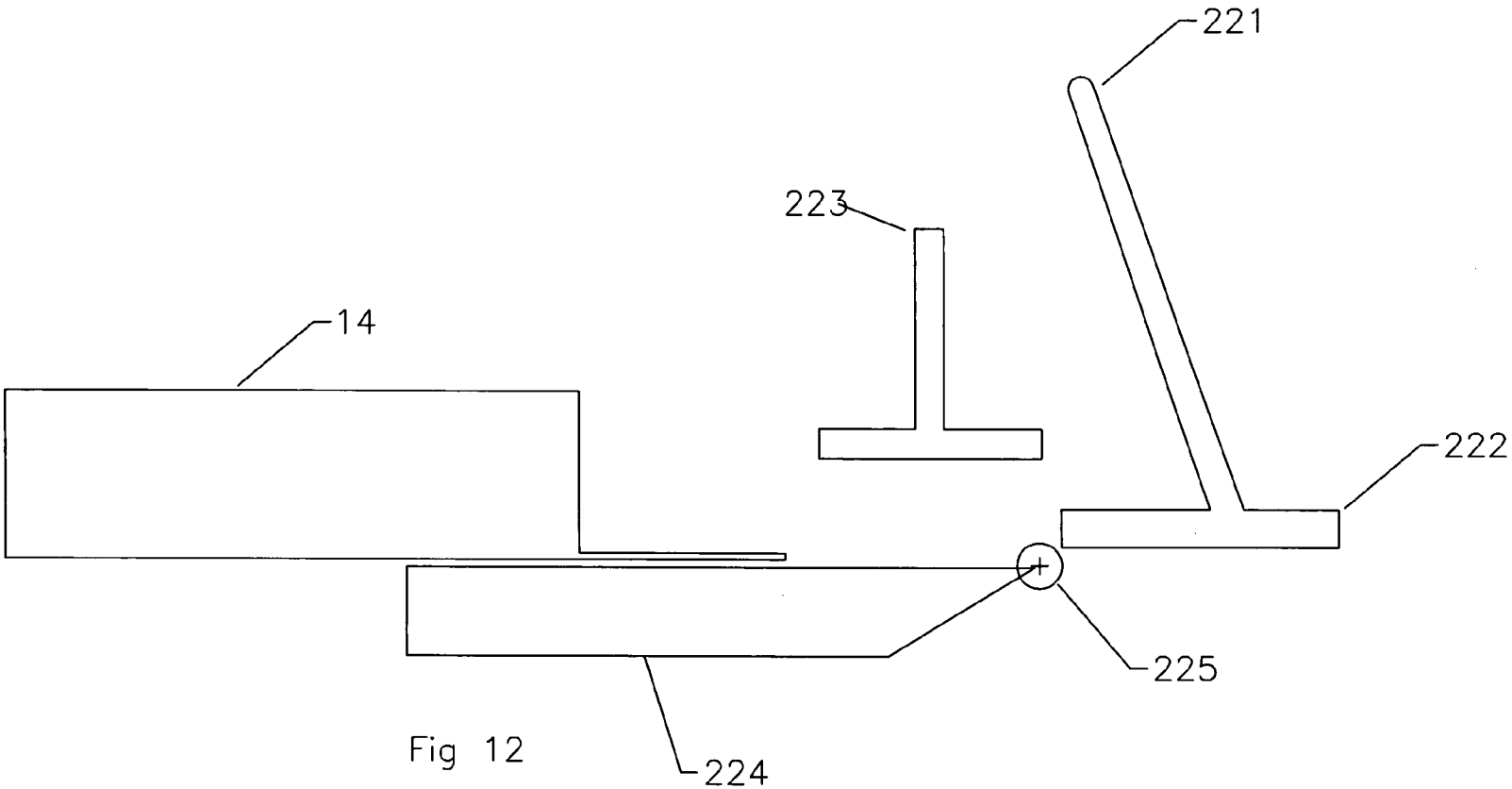
FIG. 12 shows the roofing panel and hemmer in an initial position.
Figure 13:
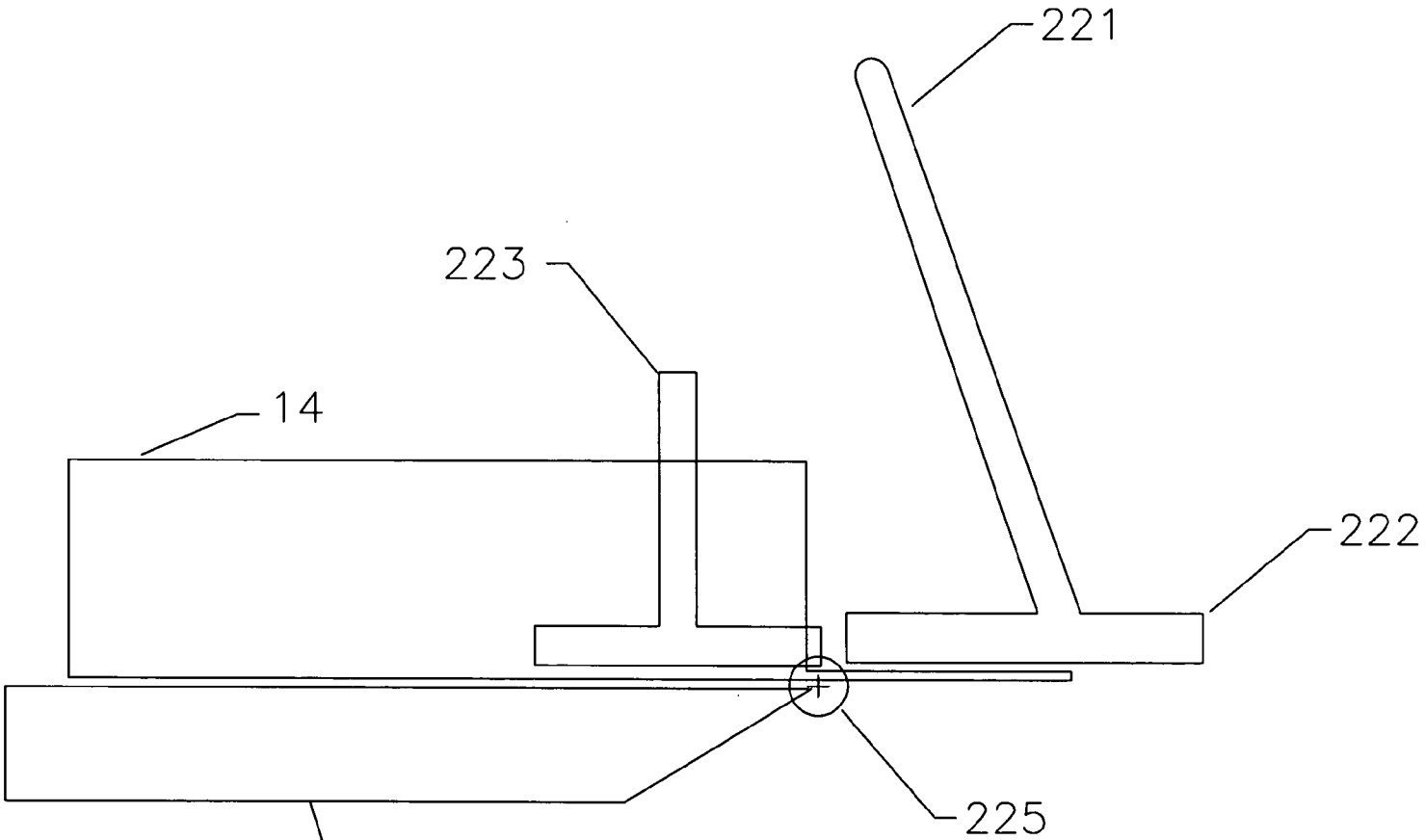
FIG. 13 shows the roofing panel inserted into the hemmer.
Figure 14:
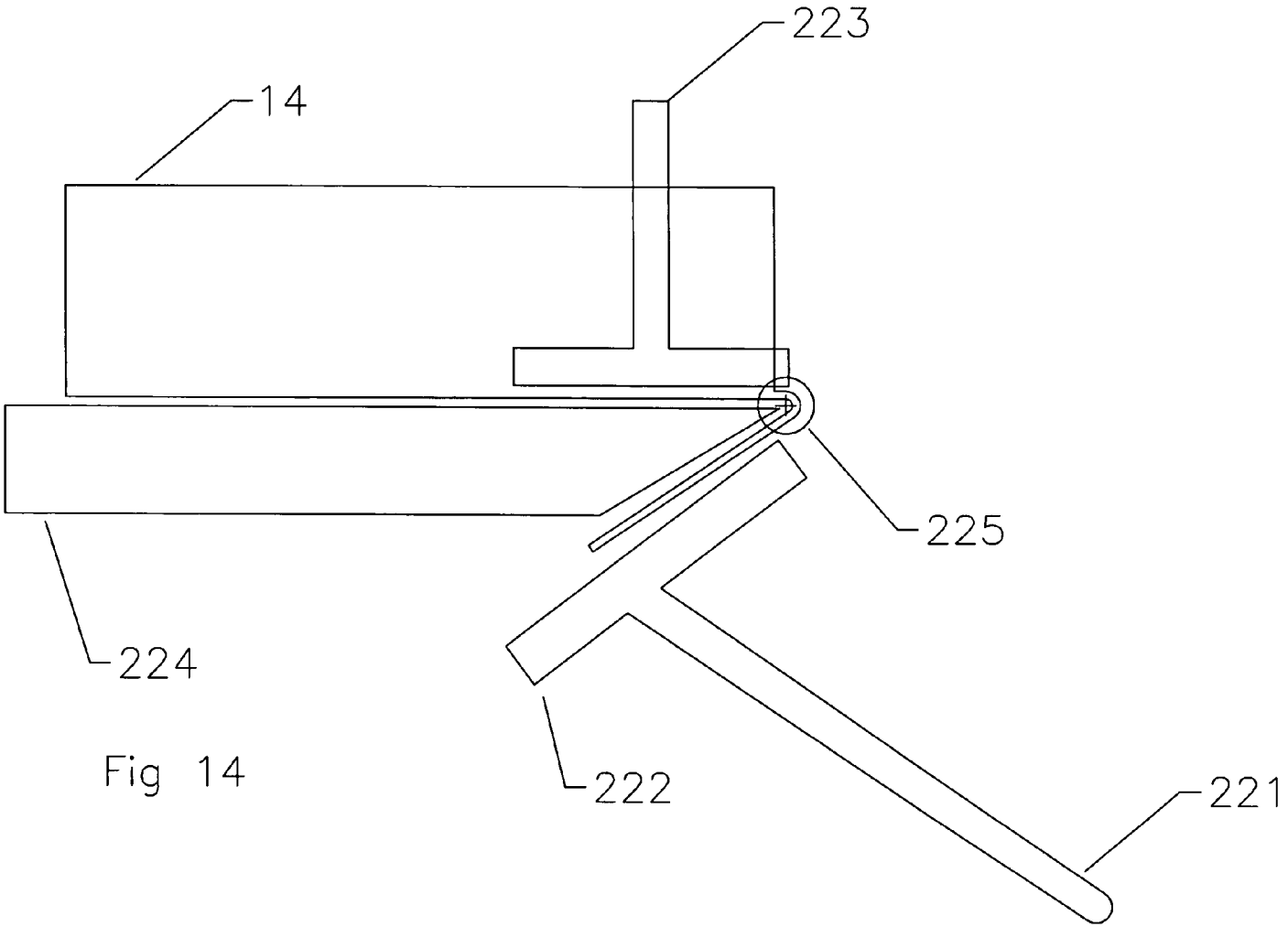
FIG. 14 shows the roofing panel being bent around the brake pivot.
Figure 15:
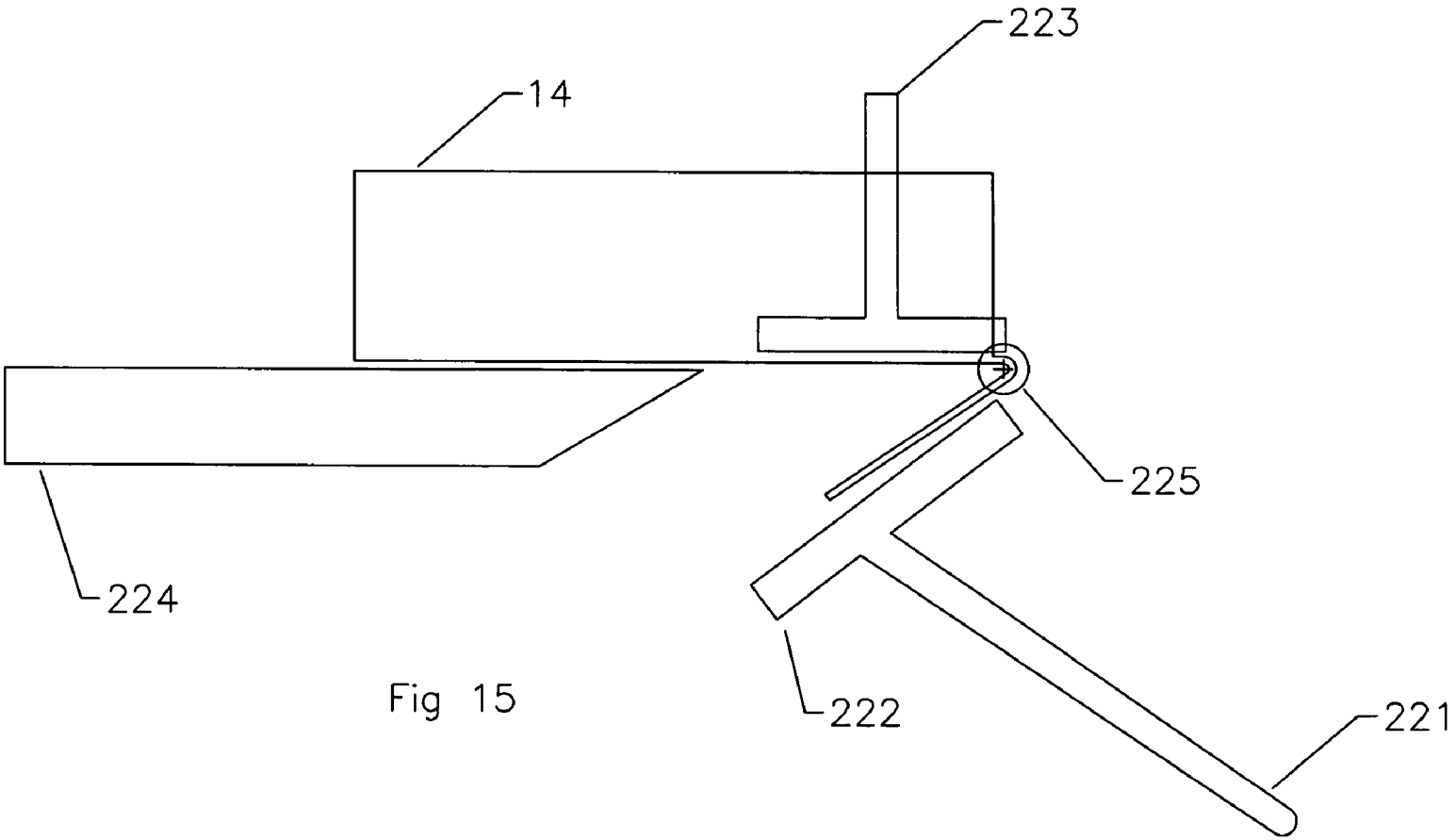
FIG. 15 shows the hold down released and the roofing panel repositioned for flattening.
Figure 16:
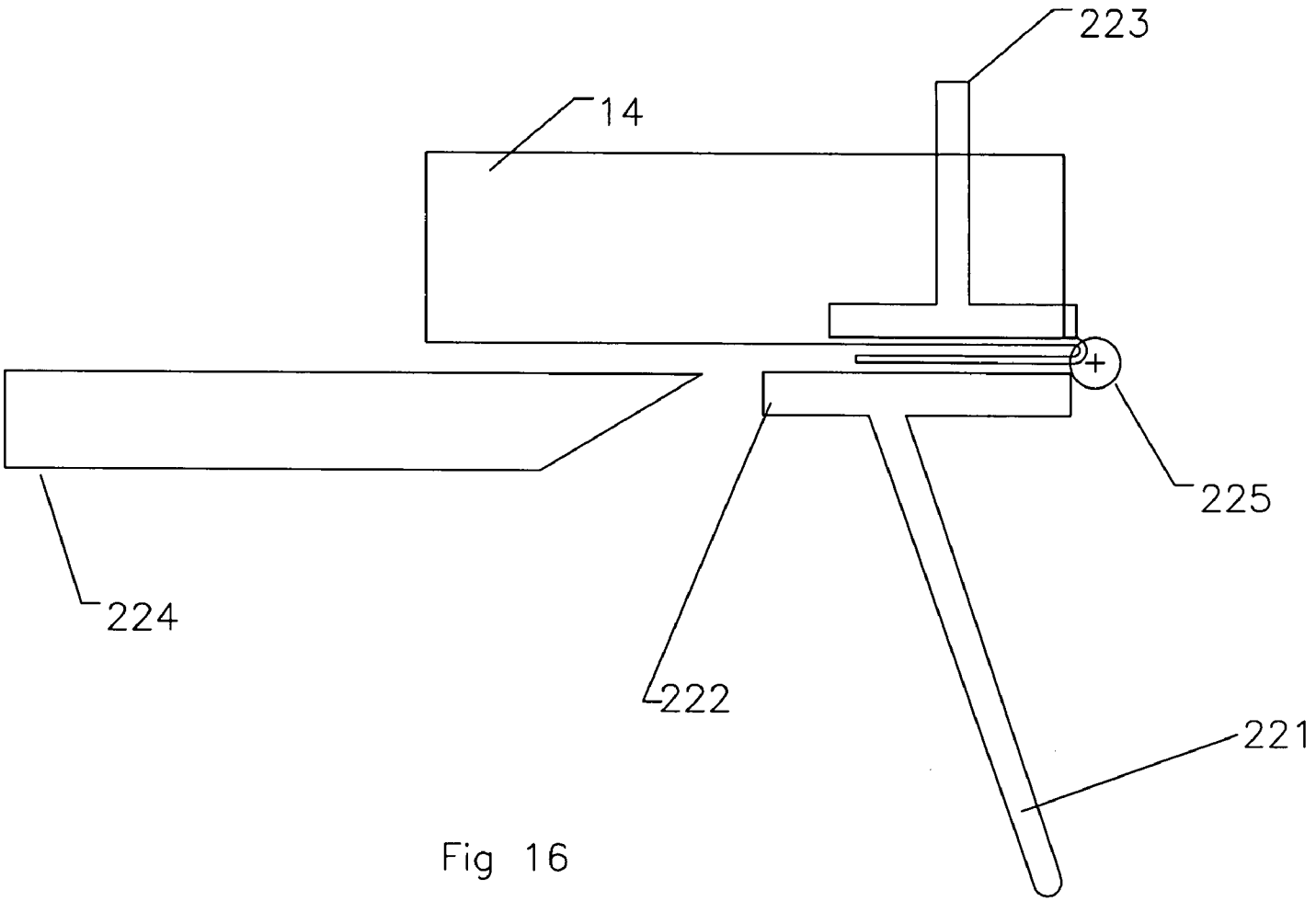
FIG. 16 shows the roofing panel after flattening.
Figure 17:
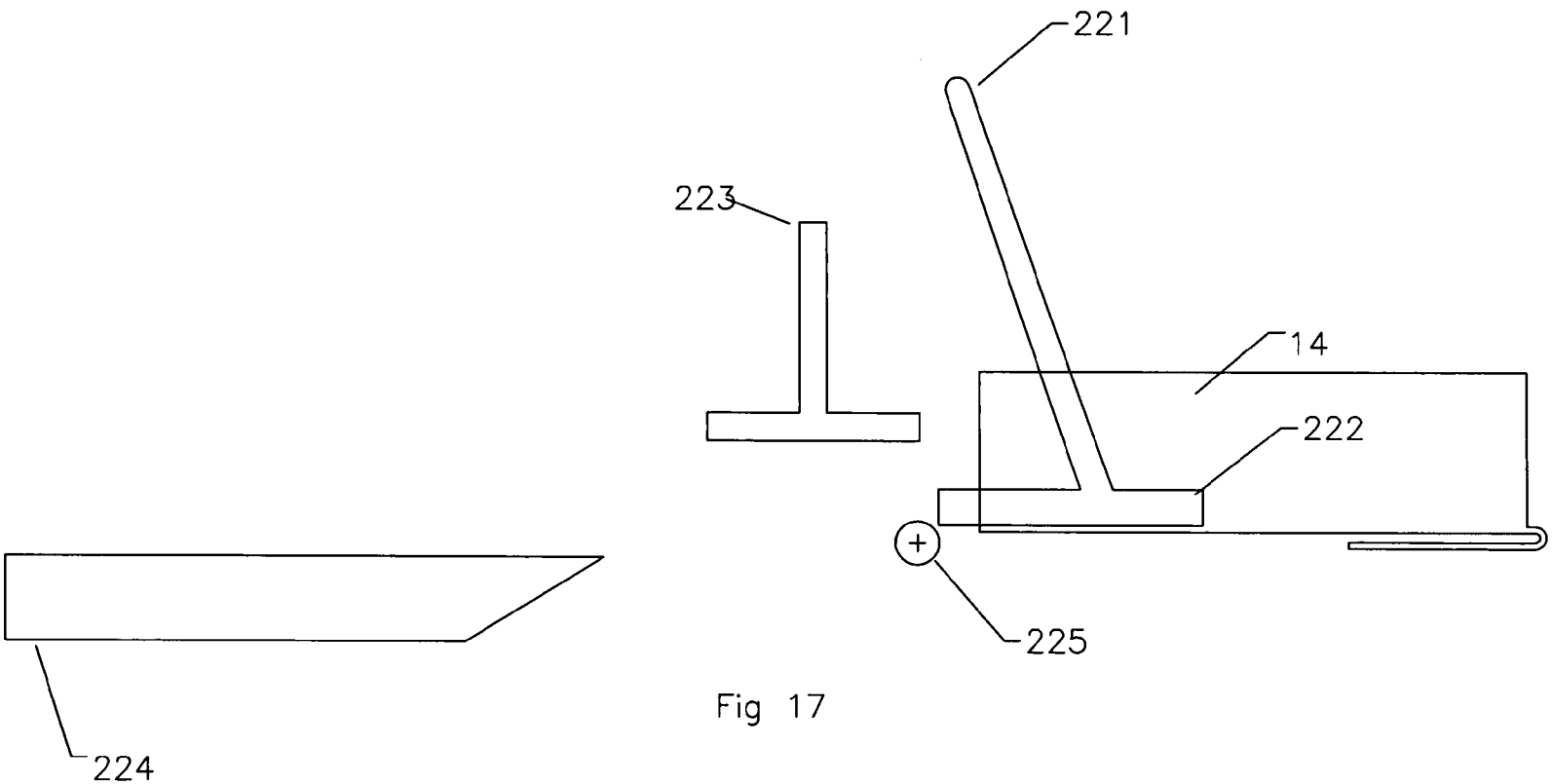
FIG. 17 shows the hold down raised to release the finished panel.

For panels that are to be installed in valleys or at eaves, the panel 14 is moved to the hemmer 22 located at the end of the table 12 so that the tongue section of the panel 14 can be hemmed. The hemmer 22 comprises a brake handle 221 and a brake plate 222. A hold down 223 is used to secure the tongue of the panel 14 on an angled panel support 224. One method of performing the hemming operation is illustrated in FIGS. 12–17. In FIG. 12, the hemmer 22 is open, ready to receive the notched panel 14. In FIG. 13, the hold down 223 has been placed on the panel 14 to hold it in position on the brake pivot 225 at the end of the panel support 224. FIG. 14 shows the brake handle 221 being rotated so that brake plate 222 folds the tongue of the panel 14 under to an approximately 140° angle. In FIG. 15, panel support 224 is retracted, allowing the brake plate 222 to continue to bend the panel 14. As shown in FIG. 16, the brake plate 222 continues to rotate until the tongue of the panel 14 is flattened to an angle of 180°. When the hemming is complete as in FIG. 17, the brake plate 222 rotates to its home position, the hold down plate 223 is released, and the panel 14 is removed from the hemmer 22, and is ready for installation.

Figure 18:
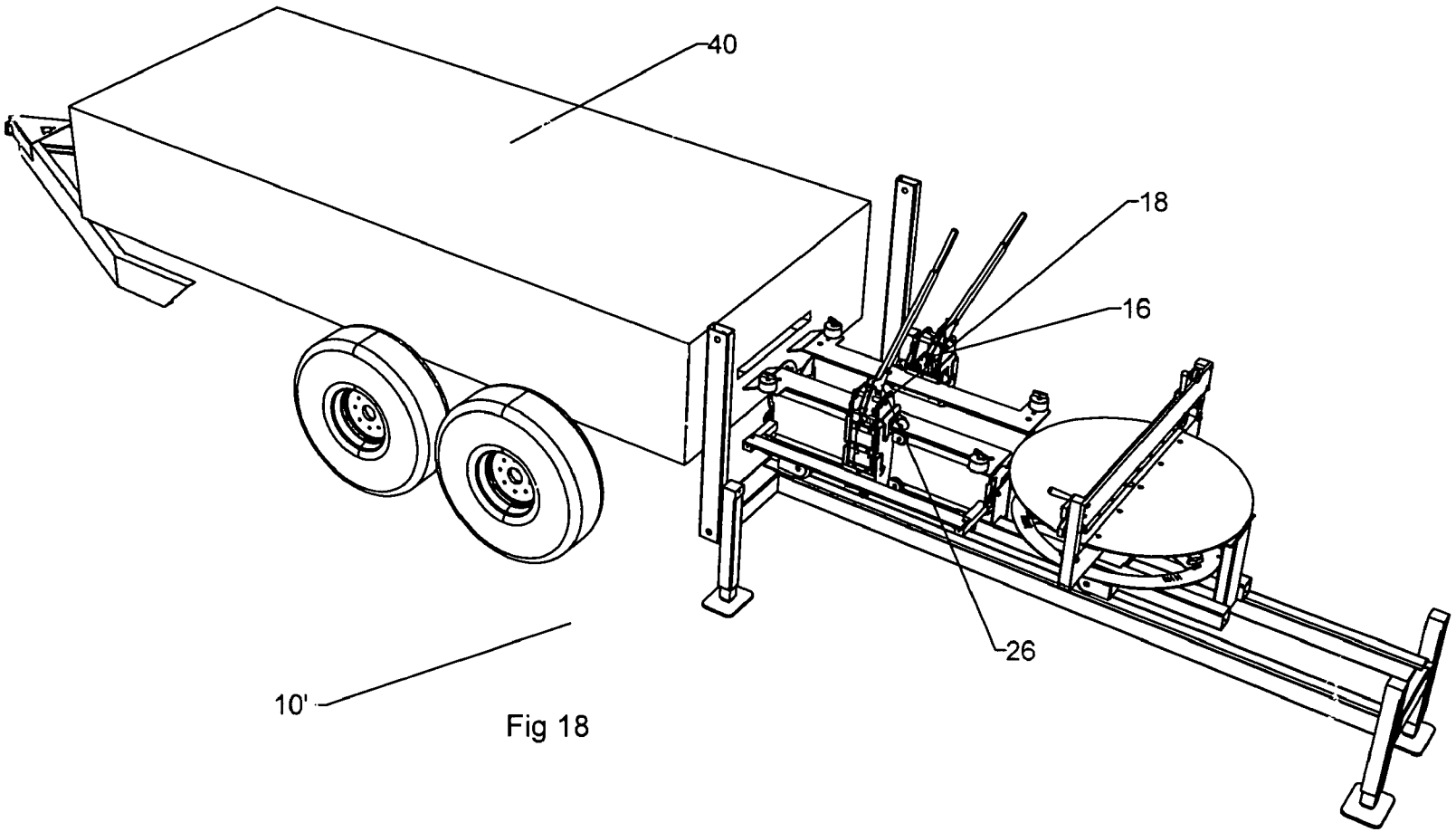
FIG. 18 is a perspective view of notchers connected to a roll former.

While the notching, shearing, and hemming tool 10 is disclosed above as a stand alone tool, the tool may also be utilized in conjunction with a roll forming machine 40, as is illustrated in FIG. 18. In this conformation, the notching, shearing, and hemming tool 10' is positioned at the output end of the roll former 40. The roofing panel 14 is fed into the panel alignment section 26 after it is formed to begin the notching procedure. Operation of the automated tool 10' is identical to that of the stand alone tool 10, the exception being that if desired, the notchers can be powered by hydraulic or pneumatic means.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A tool adapted to finish end pieces of roofing panels comprising:

a table adapted to receive a roofing panel, said table comprising legs that are adjustable in length, and a first notching device and a second notching device, each said notching device being adapted to remove a notch from side walls of the roofing panel; wherein at least one of said notching devices is movable relative to the other said notching device, so that a notch formed by said first notching device can be made at a different longitudinal position along a first side wall of the roofing panel relative to a notch formed by said second notching device, thereby enabling variation of an angle between said notch formed by said first notching device and said notch formed by said second notching device.

2. The tool as defined in claim 1 wherein:

said tool further comprises a pan shear pivotally mounted on said table.

3. The tool as defined in claim 1 wherein:

said tool further comprises a hemmer pivotally mounted on said table.

4. The tool as defined in claim 1 wherein:

said table comprises two side walls, at least one of said side walls having an elongated opening therein to accommodate a travel path of an associated one of said notching devices.

5. The tool as defined in claim 1 wherein:

said legs comprise a nested pair of leg sections.

6. The tool as defined in claim 1 wherein:

each said notcher comprises a bottom die, said bottom die comprising at least one supporting projection, said supporting projection being adapted to enter an open area of a female side wall of the roofing panel.

7. The tool as defined in claim 1 wherein:

each said notcher comprises a bottom die and a top die, said bottom die comprising at least one supporting projection, said supporting projection being adapted to enter an open area of a female side wall of the roofing panel, and said top die comprising a slot to receive said supporting projection of said bottom die, so that a clean cut of the side wall of the roofing panel is achieved.

8. The tool as defined in claim 1 wherein:

said hemmer comprises a brake handle, a brake plate, a hold down, and an angled panel support; wherein an exposed tongue of a notched roofing panel is secured on said panel support with said hold down, and pressure is applied to the tongue by means of said brake handle so that the tongue is bent around a brake pivot on an end of said panel support.

9. The tool as defined in claim 8 wherein:

after an initial bending operation, said panel support is retracted so that said brake handle can continue to apply pressure to the tongue of the panel so as to completely flatten the tongue.

10. The tool as defined in claim 1 wherein:

said notchers are connected to each other through a linkage mechanism so that said notchers move in unison to desired positions.

11. The tool as defined in claim 10 wherein:

said linkage mechanism comprises a plurality of link arms pivotally connected to each other and to said notchers.

12. A tool adapted to hem an exposed tongue of a notched roofing panel comprising:

a brake handle, a brake plate, a hold down, and an angled panel support; wherein the exposed tongue of the notched roofing panel is secured on said panel support with said hold down, and pressure is applied to the tongue by means of said brake handle so that the tongue is bent around a brake pivot on an end of said panel support with the notched roofing panel being in a face up position so that a hem is formed on a bottom side of the notched roofing panel.

13. The tool as defined in claim 12 wherein:

after an initial bending operation, said panel support is retracted so that said brake handle can continue to apply pressure to the tongue of the panel so as to completely flatten the tongue.

14. A tool adapted to hem an exposed tongue of a notched roofing panel comprising:

a brake handle, a brake plate, a hold down, and an angled panel support; wherein the exposed tongue of the notched roofing panel is secured on said panel support with said hold down, and pressure is applied to the tongue by means of said brake handle so that the tongue is bent around a brake pivot on an end of said panel support, and after an initial bending operation, said panel support is retracted so that said brake handle can continue to apply pressure to the tongue of the panel so as to completely flatten the tongue.

* * * * *